US007320188B2

(12) United States Patent
Bathum

(10) Patent No.: US 7,320,188 B2
(45) Date of Patent: Jan. 22, 2008

(54) RUNNING SANDAL

(75) Inventor: Dale Bathum, Sammamish, WA (US)

(73) Assignee: Crocs, Inc., Niwot, CO (US)

( * ) Notice: Subject to any disclaimer, the term of this patent is extended or adjusted under 35 U.S.C. 154(b) by 0 days.

(21) Appl. No.: 11/438,908

(22) Filed: May 22, 2006

(65) Prior Publication Data

US 2007/0022629 A1 Feb. 1, 2007

Related U.S. Application Data

(62) Division of application No. 10/644,126, filed on Aug. 20, 2003, now Pat. No. 7,121,020.

(60) Provisional application No. 60/404,707, filed on Aug. 20, 2002.

(51) Int. Cl.
*A43B 3/12* (2006.01)

(52) U.S. Cl. ..... 36/11.5; 36/102

(58) Field of Classification Search ..... 36/11.5, 36/102, 36 R
See application file for complete search history.

(56) References Cited

U.S. PATENT DOCUMENTS 4,400,894 A * 8/1983 Ehrlich ..... 36/33
5,408,761 A * 4/1995 Gazzano ..... 36/88
5,806,209 A * 9/1998 Crowley et al. ..... 36/28
6,412,196 B1 * 7/2002 Gross ..... 36/102
6,418,641 B1 * 7/2002 Schenkel ..... 36/28
6,493,965 B1 * 12/2002 Bathum ..... 36/11.5
6,634,121 B2 * 10/2003 Sordi ..... 36/102
6,637,130 B2 * 10/2003 Urie et al. ..... 36/11.5
6,708,426 B2 * 3/2004 Erickson et al. ..... 36/127
6,971,190 B2 * 12/2005 Runyan ..... 36/11.5
2003/0074806 A1 * 4/2003 Urie et al. ..... 36/11.5
2003/0172553 A1 * 9/2003 Truelsen ..... 36/102

* cited by examiner

*Primary Examiner*—Ted Kavanaugh
(74) *Attorney, Agent, or Firm*—Faegre & Benson, LLP

(57) ABSTRACT

A sandal for receiving a foot of a wearer, the foot having a heel and a forefoot including toes. The sandal includes an upper, a midsole assembly and an outsole component. The midsole assembly includes a main body and a support component that may include a slightly curved forefoot plate positioned at least partially adjacent to a bottom surface of the main body. When fitted with the curved forefoot plate, the sandal is capable of facilitating a rolling action in the direction of a stride of the wearer. The upper may form a sandal strap system, with an inner or fixed strap layer and an outer or adjustment strap layer. The outer or adjustment strap layer can be used to adjust the sandal upper so the foot of the wearer can be secured to the sandal.

9 Claims, 7 Drawing Sheets

RUNNING SANDAL

CROSS-REFERENCE TO RELATED APPLICATION

The present application is a divisional of U.S. patent application No. 10/644,126, filed Aug. 20, 2003, which claims priority to U.S. Provisional Application No. 60/404,707, filed Aug. 20, 2002, now U.S. Pat. No. 7,121,020 the disclosures of which are incorporated herein by reference in their entirety.

TECHNICAL FIELD

The present invention is directed toward footwear and more particularly toward sandal-style footwear.

BACKGROUND

During sustained activity, such as walking, hiking and running, an individual's feet are subjected to large, repetitious ground reaction or impact forces generated in a gait cycle. A runner's foot experiences these ground reaction forces at various points during a typical gait cycle. The runner's gait cycle begins with the heel strike phase, where the initial ground contact at the lateral side of the heel takes place. The heel strike phase lasts until the rest of the foot or shoe contacts the ground, known as the flat foot phase. In the flat foot phase, the runner's weight rolls forward and inward onto the forefoot as the arch collapses, and moves onto the inner and front part of the forefoot where the foot is pushed off the ground and propelled forward. The flat foot phase lasts until the runner's heel lifts, thereby beginning the toe off phase.

In the heel strike and the flat foot phases, the runner's foot typically pronates or supinates, and such pronation or supination will result in lateral movement of the runner's foot, ankle and lower leg. Conventional running shoes attempt to stabilize the runner's foot by providing a foot-encompassing supportive upper and a generally rigid heel cup shaped to snugly receive and control the runner's heel. However, shoes can be hot, especially during prolonged running in high temperatures. While sandals are open and much cooler, conventional open sandals do not have these same stabilizing mechanisms.

It would be desirable to have an open sandal for running and other activities that can provide proper support and cushioning to dissipate impact forces, limit joint motion beyond the natural motion of the foot and preserve the natural forward motion associated with a wearer's natural gait.

DETAILED DESCRIPTION

Figure 1:
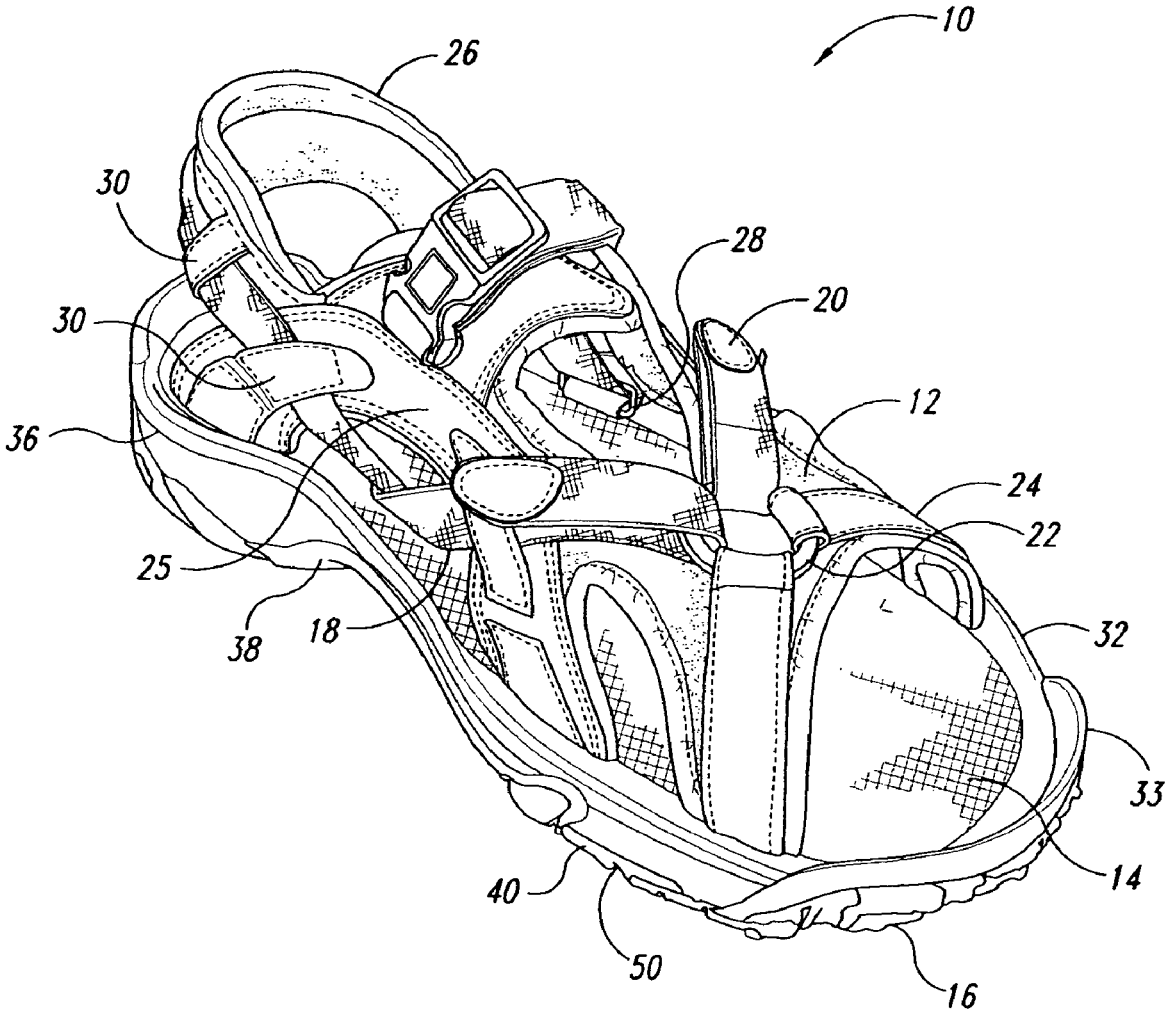
FIG. 1 is an isometric view of a sandal in accordance with an embodiment of the invention.
Figure 2:
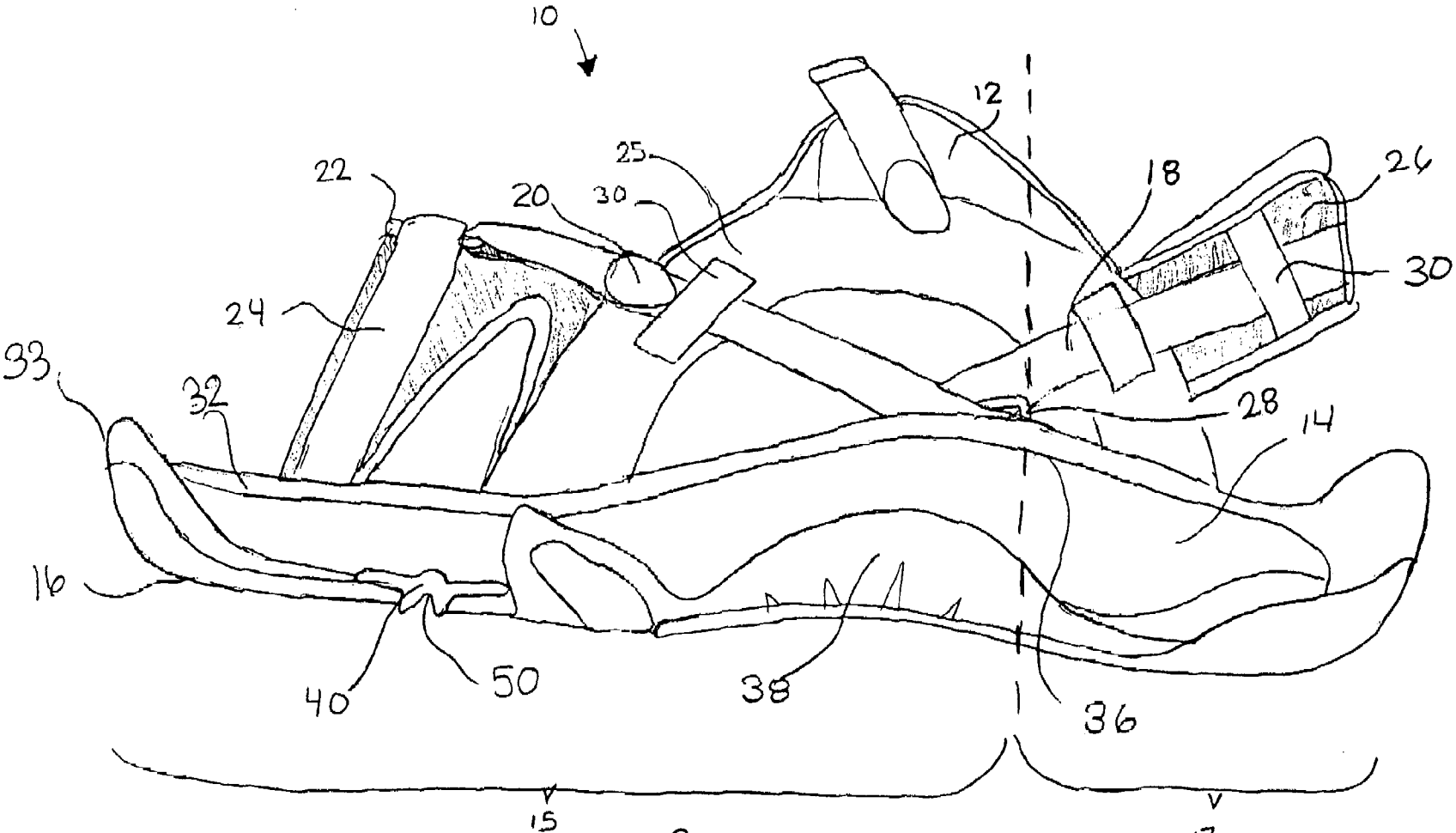
FIG. 2 is a side elevation view of the sandal of FIG. 1.

In reference to the drawings in detail, FIGS. 1 and 2 illustrate a sandal 10 in accordance with one embodiment of the present invention. The sandal 10 includes an upper 12, a midsole assembly 14 (including various cushioning and support components) and an outsole 16, together configured to provide the cushioning, stability, support and security provided by a running shoe in a lightweight and airy sandal package. A front portion 15 of the sandal 10 corresponds to a wearer's forefoot and toes (not shown), while a rear portion 17 of the sandal corresponds to a wearer's heel area (not shown) in the sandal 10.

The upper 12 is shaped and sized to receive and secure the wearer's foot (not shown). The upper 12 of the illustrated embodiment includes a plurality of fixed straps connected to the midsole assembly 14, including front straps 24, side lateral/medial straps 25 and a heel strap 26. The upper 12 also includes a movable adjustment strap 18. The adjustment strap 18 is configured in combination with the fixed straps (24, 25 and 26) to form a sandal strap system for comfortably securing the wearer's foot on the midsole assembly 14 during strenuous activities such as running or the like.

In the embodiment illustrated in FIGS. 1 and 2, the adjustment strap 18 has two end portions 20, each being looped around a center ring or adjustment member 22 fixed to one or more of the front straps 24 of the upper 12 and fastened back to a mid portion of the adjustment strap 18. In the illustrated embodiment, a hook-and-loop material, such as Velcro™ is used to fasten the adjustment strap 18 to itself. In alternate embodiments, fasteners such as snaps, hooks, clips, ties, buckles, etc. may be used. The adjustment strap 18 extends down both sides of the sandal upper 12 and around the heel strap 26. On both the lateral and medial sides of the sandal, the adjustment strap 18 passes through midsole keepers 28 or loops secured to the midsole assembly 14. The adjustment strap 18 is also secured at various points on the heel strap 26 and lateral/medial straps 25 by passing through various strap keepers 30 or other retention devices.

Figure 8:
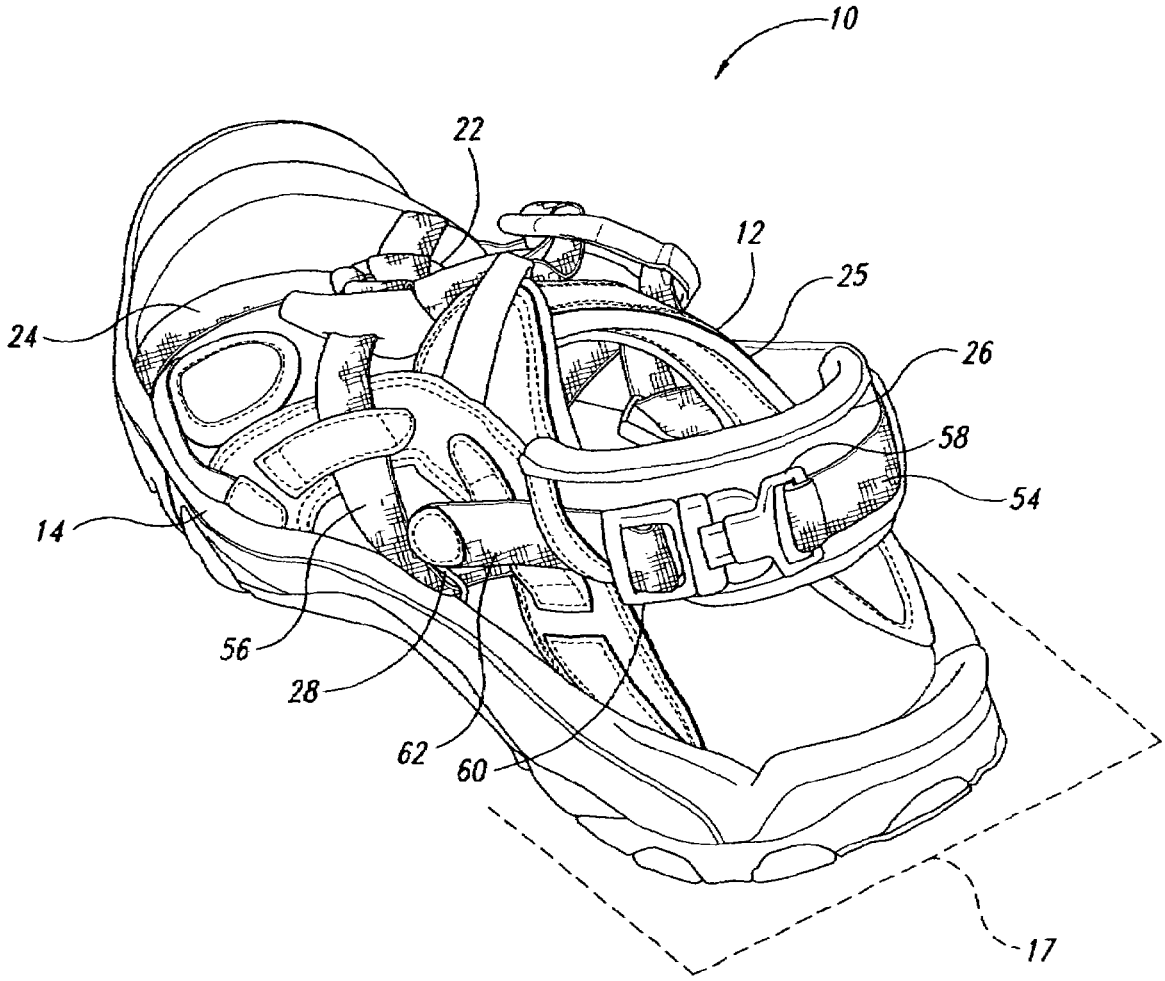
FIG. 8 is a rear isometric view of a sandal upper in accordance with an alternate embodiment of the invention.

When one or both of the end portions 20 of the adjustment strap 18 are pulled back and down toward the rear portion 17 of the sandal, the adjustment strap 18 slides through the adjustment member 22 to snugly secure the front straps 24 over the instep and forefoot area of the wearer's foot (not shown). The adjustment strap 18 also slides through the fixed keepers 30 and midsole keepers 28 of the sandal strap system, thereby pulling the heel strap 26 forwardly and securely against the heel portion of the wearer's foot. Accordingly, a single adjustment of the sandal's adjustment strap 18 secures the sandal's upper 12 around the forefoot and heel portion of the wearer's foot, anchoring the wearer's foot evenly and firmly into the sandal 10 so the wearer can experience a stable and secure feeling. In an alternate embodiment (not shown), the adjustment strap 18 may be securely fixed to the midsole assembly 14 and/or fixed straps (24, 25 and 26) at one or more points. In a second alternate embodiment, multiple adjustment straps may be configured to form a sandal strap system as shown in FIG. 8 and described in more detail below.

The adjustment strap 18 and fixed straps (24, 25 and 26) of the upper 12 securely hold the wearer's foot in place on a contoured footbed formed by the midsole assembly 14.

The midsole assembly 14 is positioned between the outsole 16 and the sandal upper 12 and may be fitted or sculpted with high sidewalls 32 for protection of the sides of the wearer's foot. In the illustrated embodiment, the outward facing portions of the sidewalls 32 are creased or grooved with a soft lateral release line 36 to promote the wearer's natural gait to the lateral side. For additional protection, a toe guard 33 extends from the front of the midsole assembly 14 to protect the toes of the wearer. In some embodiments, the toe guard 33 may not be provided, or may be removable.

Figure 3:
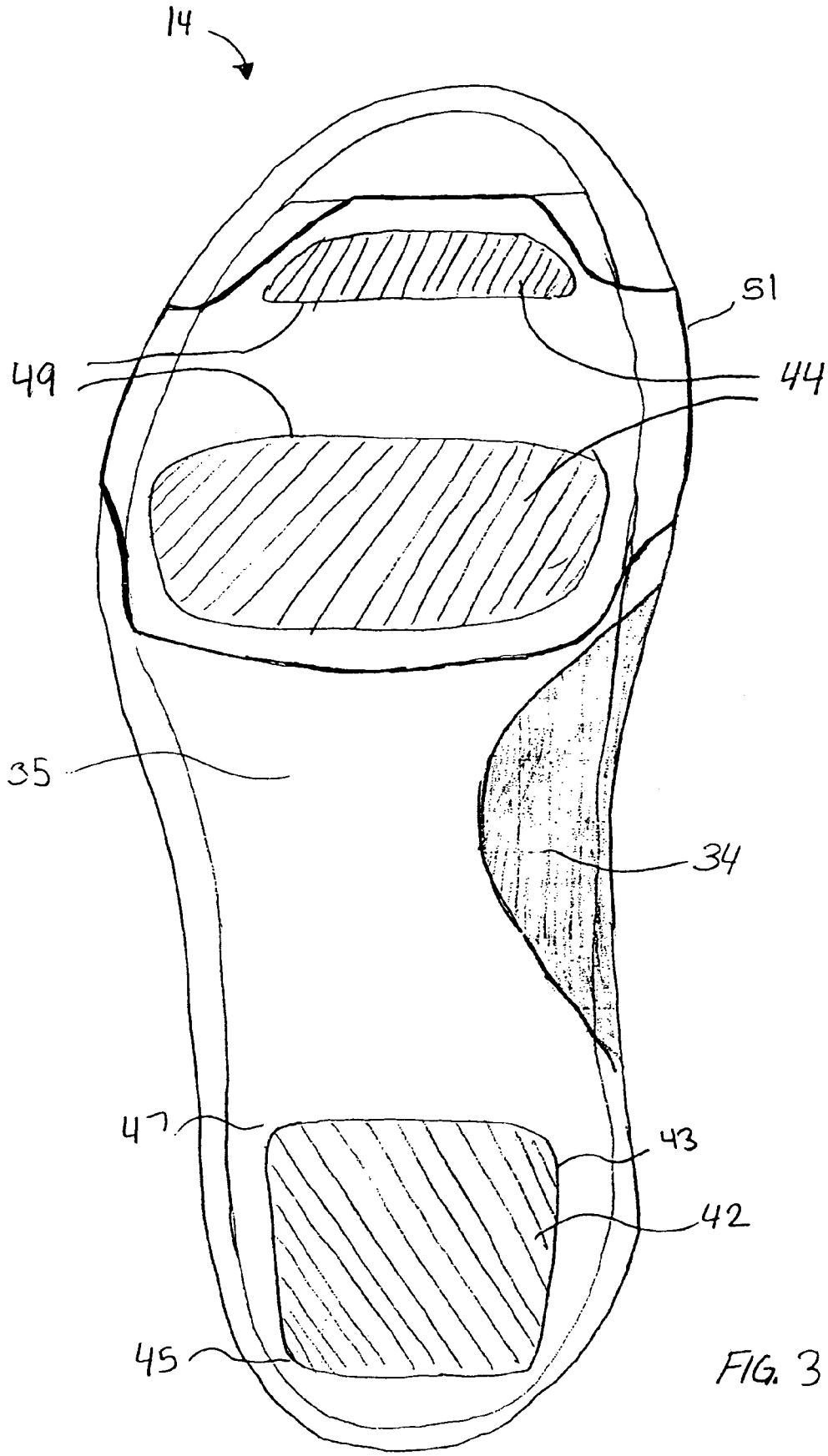
FIG. 3 is a bottom plan view of a midsole assembly of the sandal of FIG. 1.
Figure 4:
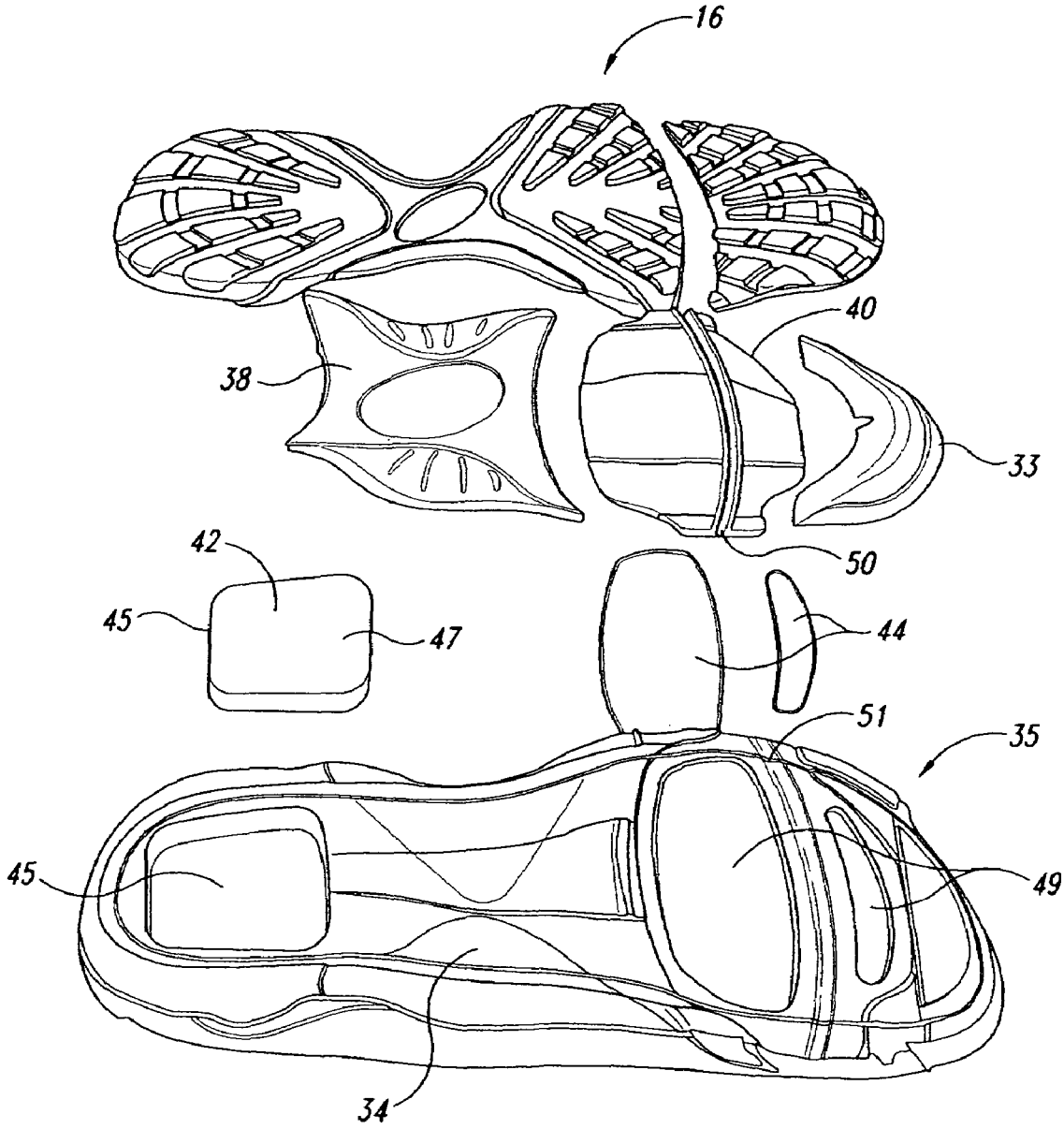
FIG. 4 is an isometric view of a disassembled midsole assembly of the sandal of FIG. 1.

As best illustrated in FIGS. 3 and 4, the midsole assembly 14 includes a main body 35 shaped with various cavities to receive a plurality of components that provide stability and/or cushioning. In the illustrated embodiment, these components include a shock absorbing shock pad 42, a plurality of energy-returning launch pads 44, a stabilizer 38 and a curved forefoot plate 40.

The main body 35 of the midsole assembly 14 is constructed of a shock-absorbing material. While Phylon is used to construct the main body 35 of the midsole assembly 14 in the illustrated embodiment, other materials may be used, including materials such as ethylene vinyl acetate (EVA) foam, polyurethane foam or a combination of materials (e.g., a dual-density midsole).

As shown in FIGS. 3 and 4, the shock pad 42 is received and retained in a cavity 43 integrally formed in the heel area of the main body 35 of the midsole assembly 14. The shock pad 42 is positioned to be approximately under the heel of the wearer's foot (not shown). In the illustrated embodiment, the shock pad 42 has a generally trapezoidal shape that extends toward the front portion 15 of the sandal 10 from a slightly narrower rear side 45 to a slightly wider front side 47.

The shock pad 42 is made of a high-density foam material having very good energy absorption characteristics, so as to absorb and dissipate impact forces generated during the heel strike phase of the wearer's gait cycle. The shock pad 42 of the illustrated embodiment is constructed of polyurethane, although, in other embodiments, various other materials may be used to construct the shock pad 42, such as EVA, rubber, brown rubber (resilient EVA), etc.

The shock pad 42 is complimented by the energy returning launch pads 44 placed in the area of the midsole assembly 14 that approximately correspond with the metatarsals bones (not shown) of the wearer's foot. As best seen in FIGS. 3 and 4, the oblong-shaped launch pads 44 fit into cavities 49 in the main body 35 of the midsole assembly 14. In the illustrated embodiment, two independent launch pads 44 are provided, one placed such that it approximately corresponds to the toes (not shown) of the wearer's foot and a second placed such that it approximately corresponds with the ball (not shown) of the wearer's foot when the sandal is worn. In an alternate embodiment (not shown), a single launch pad 44 is provided. In a second alternate embodiment (not shown) more than two launch pads 44 are provided.

In the illustrated embodiment, the launch pads 44 are made of a high-density foam having very good energy absorptive characteristics as well as energy rebound characteristics to facilitate the conservation of reaction forces that propel the wearer's foot off the ground during the toe-off phase, as well as to provide some cushioning from initial ground impact. The foam may be constructed from materials such as polyurethane, EVA, rubber or brown rubber.

The composition and placement of the launch pads 44 promote forward acceleration in the direction of the wearer's stride during the phase of the wearer's stride where the wearer's body weight shifts forward toward the forefoot and away from the heel, and during the toe-off phase.

Along with cushioning features, the midsole assembly 14 may be fitted with various support features. As shown in FIGS. 1, 2 and 4 the stabilizer 38 is positioned between the main body 35 of the midsole assembly 14 and the outsole 16 at a location generally corresponding to the arch area and midfoot area of the wearer's foot to provide support for the wearer's foot. The stabilizer 38 may be constructed of a semi-flexible material that allows for some fore and aft flexion while maintaining appropriate lateral support and support for the wearer's arch. For additional support, the midsole assembly 14 may be constructed with a firmer density material 34 (FIG. 3) positioned at the arch area of the wearer's foot, providing arch support. These support features aid in the flow of the kinetic energy generated by the wearer's motion, allowing the wearer to maintain a flowing smooth stride while running.

The midsole assembly 14 also includes the curved forefoot plate 40 that forms a longitudinal roll bar to further promote a flowing smooth stride, to help maintain the forward acceleration associated with the wearer's stride, and to avoid the bothersome toe slap, which is commonly experienced in prior art sandals. In the illustrated embodiment, the curved forefoot plate 40 is positioned at the bottom of the midsole assembly 14 covering an area that corresponds approximately with the forefoot of the wearer's foot when the sandal is worn. However, in an alternate embodiment (not shown) the curved forefoot plate 40 may be placed within or adjacent to the main body 35 of the midsole assembly 14. The curved forefoot plate 40 is curved upward at both a front portion 45 and a rear portion 47 in a manner so as to allow for a fore and aft rolling action consistent with the wearer's natural gate. This curvature is best shown in FIG. 6, a lateral view of the curved forefoot plate 40 taken substantially along line 6-6 of FIG. 5.

In the illustrated embodiment, the curved forefoot plate 40 is thin enough to fit between the main body 35 of the midsole assembly 14 and the outsole 16 without adding bulk at the front portion 15 of the sandal 10. The curved forefoot plate 40 is otherwise shaped with curved exterior edges to conform approximately to the bottom front portion of the midsole assembly 14. The curved forefoot plate 40 may be constructed of a material that is flexible enough to allow proper forefoot flexion, but yet structurally rigid enough to promote the natural rolling action associated with the wearer's gait. For example, materials such as TPU, hytrel, nylon, delrin, PVC and thermoplastic may be used.

Figure 5:
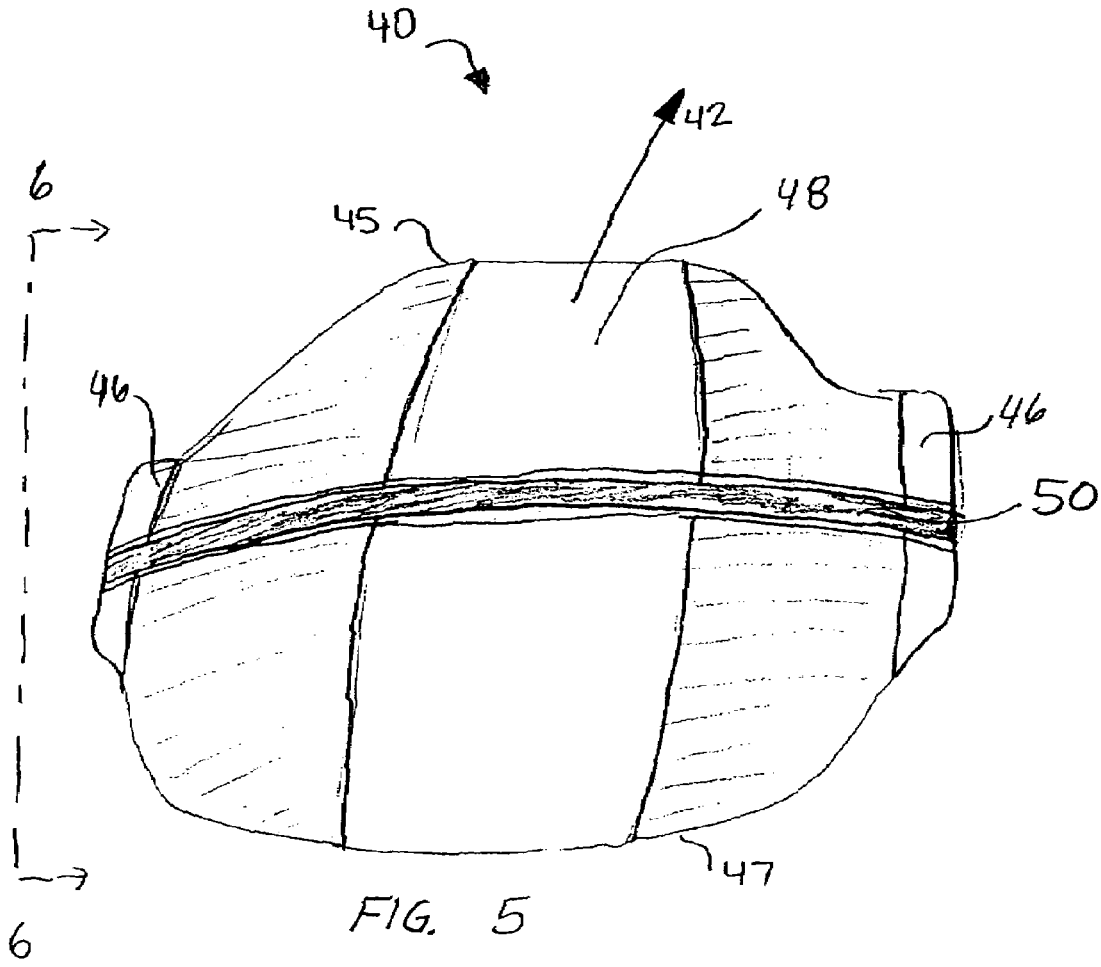
FIG. 5 is an enlarged bottom plan view of a curved forefoot plate of the sandal of FIG. 1; the curved forefoot plate shown removed from the midsole assembly of the sandal.
Figure 6:
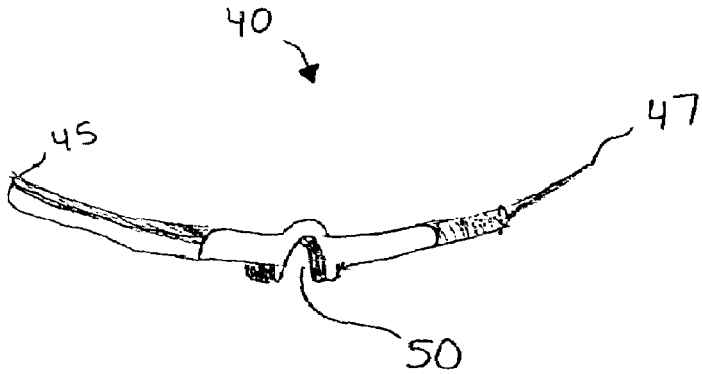
FIG. 6 is a side elevation view of the curved forefoot plate taken substantially along line 6-6 of FIG. 5.

As best illustrated in FIG. 5, the curved forefoot plate 40 includes a raised or thickened center portion or stiffening rib 48, extending from the center rear portion 47 of the curved forefoot plate 40 toward the center front portion 45 of the curved forefoot plate 40. Similar stiffening ribs may be found on the outer side edges of the curved forefoot plate. The stiffening rib 48 is angled slightly toward the big-toe of the wearer's foot so as to align with the forces and direction of movement of the wearer's foot during the phase of the gate cycle where there is a natural tendency for the wearer's foot to pronate inward. An arrow 42 in FIG. 5 depicts the typical direction of this inward movement. The stiffening rib 48 is thicker and acts to hold the main body 35 of the midsole assembly 14 in a curved shape. The portions of the curved forefoot plate 40 adjacent to the stiffening rib 48 are thinner so as to help control the over-all stiffness of the curved forefoot plate 40.

In the illustrated embodiment a concave flex groove 50 runs approximately laterally across the center of the curved forefoot plate 40, oriented horizontally with respect to the front portion 45 and rear portion 47 of the curved forefoot plate 40. The flex groove 50 adds targeted flexibility to the curved forefoot plate 40, reducing some of the ground reaction force transmitted through the sandal 10 to the wearer's forefoot during the flat foot phase of the wearer's gait cycle and providing a smoother toe-off. The curved forefoot plate 40 also includes side tabs 46 that allow it to be securely seated within an appropriately shaped cavity 51 (FIGS. 3 and 4) in the main body of the midsole assembly 14.

The construction, placement and configuration of the curved forefoot plate 40 promotes a forward dynamic push-off in accordance with the phase of the wearer's gait cycle in which the wearer's foot rolls forward and inward as the arch collapses and moves onto the inner and front part of the forefoot where the foot is pushed off the ground and propelled forward. Additionally, by providing a firm rolling surface, the toe-slap that typically occurs with most sandals may be reduced.

Figure 7:
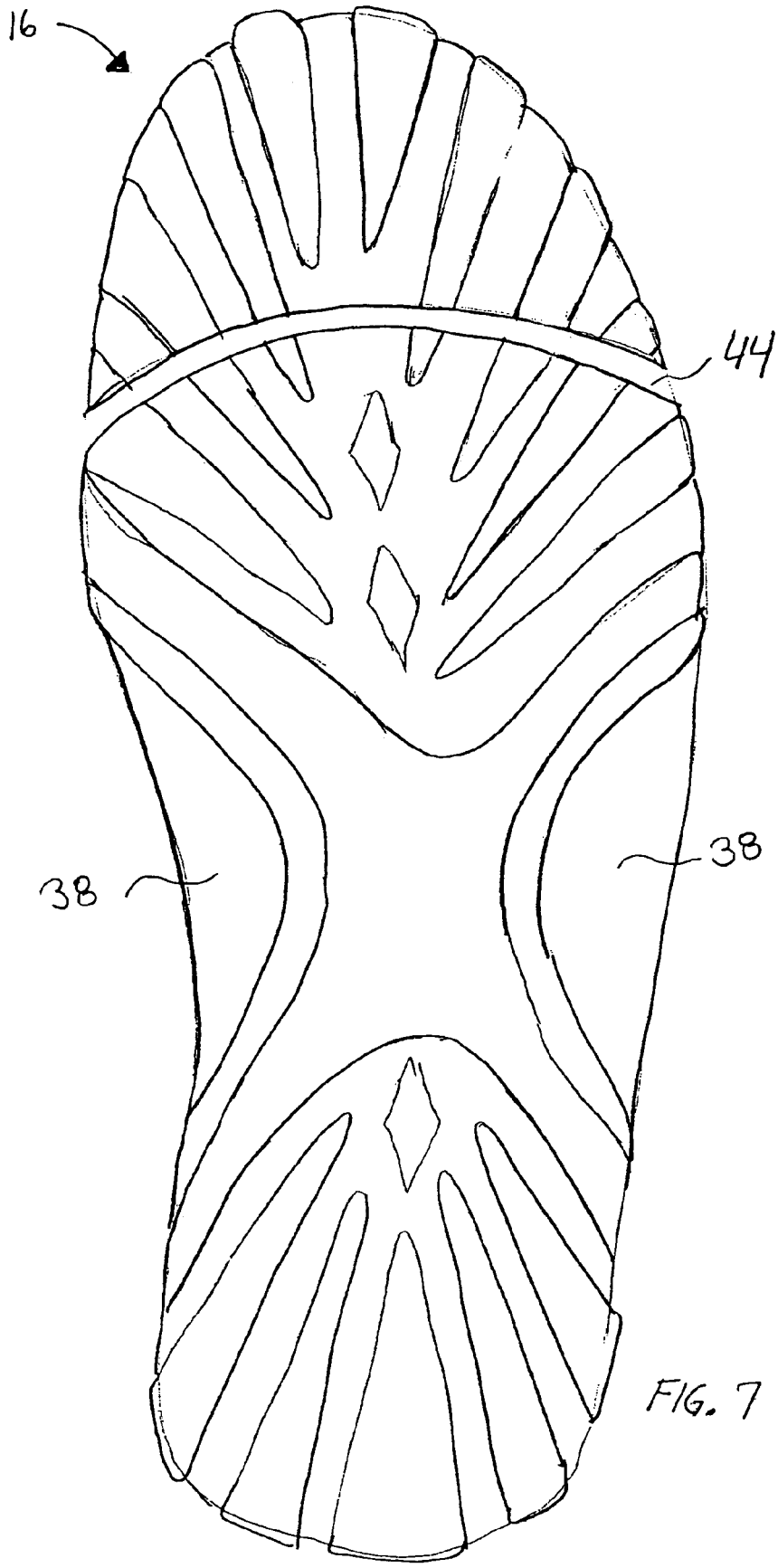
FIG. 7 is a bottom plan view of an outsole of the sandal of FIG. 1.

The dual-density outsole 16, best illustrated in FIG. 7, is constructed to provide multidirectional grip and may be adhered to at least a portion of a bottom face of the midsole assembly 14, covering the shock pad 42 and launch pads 44, as well as portions of the stabilizer 38 and curved forefoot plate 40. In the illustrated embodiment, the outsole 16 is bifurcated so that the flex groove 50 of the curved forefoot plate 40 remains exposed, allowing for appropriate flexibility and fore-aft rolling action. Outer portions of the stabilizer 38 also remain exposed.

FIG. 8 illustrates an alternative embodiment of a sandal upper 12. In this embodiment, the upper 12 includes a double sandal strap system 52 having a first adjustment strap 54 and a second adjustment strap 56. Each of the two adjustment straps (54 and 56) is fixed to the adjustment member 22. From the adjustment member 22, the first adjustment strap 54 extends down the medial side of the sandal 10 and passes through the keeper 28 located on the lateral side of the midsole assembly 14 before extending up and back toward the heel strap 26. Similarly, the second adjustment strap 56 extends from the center ring 22 down and back toward the lateral side of the sandal 10, passing through the midsole keeper or loop 28 located on the lateral side of the midsole assembly 14 before extending up and back toward the heel strap 26.

At the rear portion 17 of the sandal 10, the first adjustment strap 54 and the second adjustment strap 56 pass around the outside of the heel strap 26 and can be fastened to each other using a buckle assembly 58 or other similar fastening mechanism. In the illustrated embodiment, the first adjustment strap 54 is fixedly secured to its corresponding side of the buckle assembly 58, while the second adjustment strap 56 is adjustably looped through a self-securing buckle keeper 60 and fastened back to itself such that the functional strap length of the second adjustment strap 56 can be easily altered and secured. In the illustrated embodiment, a hook-and-loop material (not visible) is used to fasten the end of second adjustment strap 56 back to itself so an excess end portion 62 of the second adjustment strap 56 does not flap. The hook-and-loop material may also prevent the second adjustment strap 56 from working its way loose through the buckle keeper 60 after being adjusted to a desired length. This configuration allows for easy and secure single strap adjustments.

The second adjustment strap 56 can be adjusted by the wearer while the first adjustment strap 54 and the second adjustment strap 56 are separated from each other or connected via the buckle assembly 58. When the second adjustment strap 56 is properly adjusted and the buckle assembly is fastened to connect the first adjustment strap to the second adjustment strap, the front straps 24 are secured over the instep and forefoot area of the wearer's foot (not shown) and the heel strap 26 is pulled forwardly and securely against the heel portion of the wearer's foot (not shown). In the illustrated embodiment, the heel strap 26 is attached to the lateral/medial straps 25 on only the lateral side, so that it does not bunch or buckle when the second adjustment strap 54 is tightened.

From the foregoing, it will be appreciated that specific embodiments of the invention have been described herein for purposes of illustration, but that various modifications may be made without deviating from the spirit and scope of the invention.

I claim:

1. A running sandal for receiving a foot of a wearer, the foot having a heel area, an instep area, and a forefoot area, the sandal comprising:

a flexible midsole comprising a heel portion, an arch portion, and a forefoot portion, the midsole having an upper surface that supports the wearer's foot;

a strap keeper attached to the midsole and positioned adjacent to the upper surface;

a curved forefoot plate connected to the forefoot portion of the midsole, the curved forefoot plate having a partially concave shape and a stiffness greater than a stiffness of the midsole, the curved forefoot plate has an integral flex groove therein, the flex groove extending substantially laterally relative to the midsole;

an outsole attached to the midsole; and a sandal strap system comprising:

a heel strap coupled to the midsole and configured to engage the heel area of the wearer's foot;

an instep strap coupled to the midsole and configured to engage the instep area of the wearer's foot; and a forefoot strap coupled to the midsole and configured to engage the forefoot area of the wearer's foot; and an adjustment strap attached to the heel strap, extending through the strap keeper, and connected to an adjustment member, wherein the adjustment strap is adjustable at the adjustment member to simultaneously adjust the position of the heel strap, and the forefoot strap relative to the wearer's foot to tighten or loosen the strap system.

2. The running sandal of claim 1 wherein the midsole assembly further includes a toe guard.

3. The running sandal of claim 1 wherein the adjustment member is connected to the forefoot strap.

4. The running sandal of claim 1 wherein the midsole is made of a first material, and further comprising a shock-absorbing pad made of a second material different from the first material, wherein the shock-absorbing pad is positioned to dampen and absorb impact loads from the heel area of the wearer's foot.

5. The running sandal of claim 1 wherein the midsole is made of a first material, and further comprising an energy-returning pad made of a second material different from the first material, wherein the energy-returning pad is positioned for transferring energy in an area under the wearer's forefoot area.

6. The running sandal of claim 1 wherein the midsole is made of a first material, wherein the curved forefoot plate is made of a second material different from the first, and further comprising:

a shock-absorbing pad made of a third material different from the first and second materials, wherein the shock-absorbing pad is positioned to dampen and absorb impact loads from the heel area of the wearer's foot; and an energy-returning pad made of a fourth material different from the first, second, and third materials, wherein the energy-returning pad is positioned for transferring energy in an area under the wearer's forefoot area.

7. The running sandal of claim 1 wherein the curved forefoot plate is sandwiched between the midsole and the outsole.

8. The running sandal of claim 1 wherein the curved forefoot plate is embedded within the midsole.

9. The running sandal of claim 1 further comprising a stabilizing arch support.

* * * * *